US009583833B2

(12) United States Patent
Nosov et al.

(10) Patent No.: US 9,583,833 B2
(45) Date of Patent: Feb. 28, 2017

(54) RESONANT COMPOUND ANTENNA STRUCTURE

(71) Applicant: Continental Automotive Systems, Inc., Auburn Hills, MI (US)

(72) Inventors: Eugene Ivanovich Nosov, Rochester Hills, MI (US); David James Reimus, Waterford, MI (US); Delia Perez, Rochester Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 305 days.

(21) Appl. No.: 14/020,652

(22) Filed: Sep. 6, 2013

(65) Prior Publication Data

US 2014/0062828 A1 Mar. 6, 2014

Related U.S. Application Data

(60) Provisional application No. 61/697,617, filed on Sep. 6, 2012.

(51) Int. Cl.

*H01Q 7/00* (2006.01)
*H01Q 1/24* (2006.01)
*H01Q 9/42* (2006.01)

(52) U.S. Cl.

CPC ..... *H01Q 7/00* (2013.01); *H01Q 1/243* (2013.01); *H01Q 9/42* (2013.01); *Y10T 29/49016* (2015.01)

(58) Field of Classification Search

CPC ..... H01L 9/42; H01L 9/42; H01Q 7/00
USPC ..... 343/702, 866, 728, 867, 842; 29/600
See application file for complete search history.

(56) References Cited

U.S. PATENT DOCUMENTS

| | | | | |
|---|---|---|---|---|
| 2,185,336 | A * | 1/1940 | Gerardi | H04B 1/163 343/748 |
| 3,588,905 | A * | 6/1971 | Dunlavy | H01Q 7/00 343/741 |
| 4,031,468 | A * | 6/1977 | Ziebell et al. | 455/346 |
| 4,433,336 | A * | 2/1984 | Carr | H01Q 21/29 343/728 |
| 4,564,843 | A * | 1/1986 | Cooper | 343/745 |
| 4,758,166 | A * | 7/1988 | Bonnett | H01Q 9/265 343/711 |
| 6,762,723 | B2 * | 7/2004 | Nallo | H01Q 1/243 343/700 MS |
| 7,761,115 | B2 * | 7/2010 | Castaneda et al. | 455/562.1 |
| 8,723,750 | B2 * | 5/2014 | Podduturi | 343/795 |
| 2004/0108966 | A1 * | 6/2004 | McKivergan | H01Q 1/362 343/895 |
| 2006/0109182 | A1 * | 5/2006 | Rosenberg | H01Q 1/243 343/702 |
| 2006/0109183 | A1 * | 5/2006 | Rosenberg | H01Q 1/243 343/702 |
| 2008/0316121 | A1 * | 12/2008 | Hobson et al. | 343/702 |

(Continued)

*Primary Examiner* — Dameon E Levi
*Assistant Examiner* — Ab Salam Alkassim, Jr.

(57) ABSTRACT

A resonant structure, antenna system and method for improving the wireless performance of an interior antenna of a vehicular or mobile device is disclosed. The resonant structure comprises an inductive section configured to inductively couple to an interior antenna and a capacitive section configured to capacitively couple to a ground plane. The inductive section and the capacitive section are communicatively coupled to each other. The interior antenna is configured to be contained in a device package.

19 Claims, 4 Drawing Sheets

(56) References Cited

U.S. PATENT DOCUMENTS

| | | | | |
|---|---|---|---|---|
| 2009/0126973 | A1* | 5/2009 | Martin Hernandez | B64D 45/02<br>174/138 D |
| 2010/0134350 | A1* | 6/2010 | Mohammadian | 342/357.06 |
| 2015/0048845 | A1* | 2/2015 | Petereit | H03K 17/955<br>324/663 |

* cited by examiner

RESONANT COMPOUND ANTENNA STRUCTURE

CROSS REFERENCE TO RELATED APPLICATIONS

This application claims priority to U.S. Provisional Application No. 61/697,617 filed on Sep. 6, 2012 and incorporates the said U.S. Provisional Application by reference.

BRIEF DESCRIPTION OF THE DRAWINGS

For a more complete understanding of the disclosure, reference should be made to the following detailed description and accompanying drawings wherein.

Figure 1:
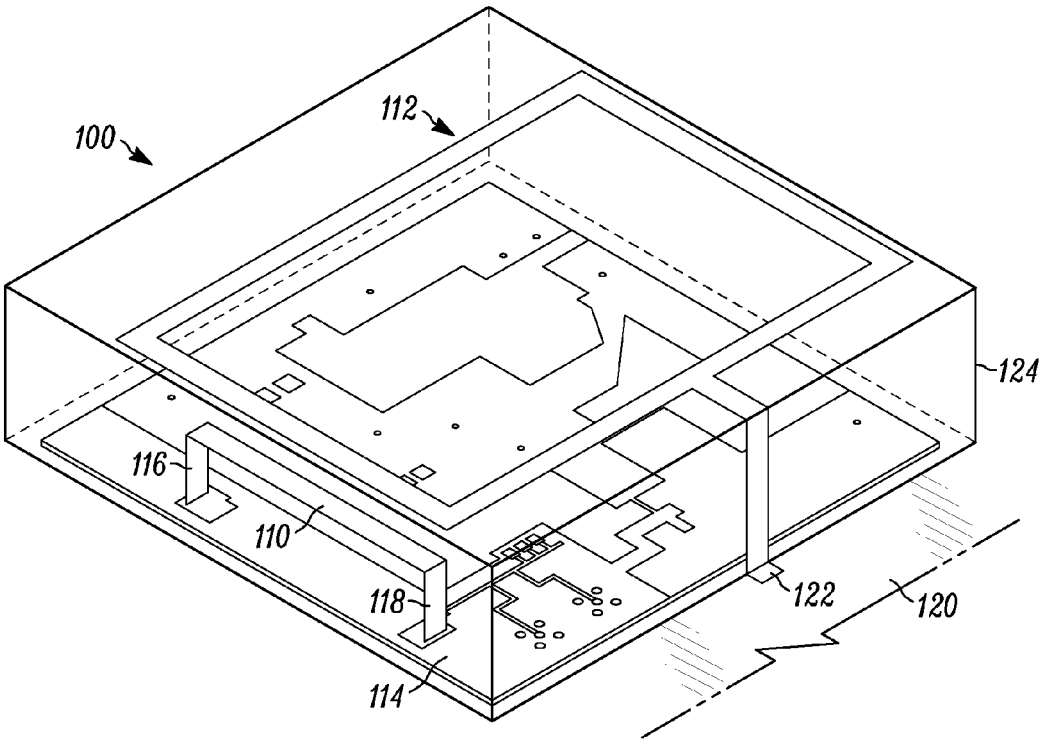
FIGS. 1-4 comprise schematic pictorial views of exemplary resonant compound antenna systems.

Skilled artisans will appreciate that elements in the figures are illustrated for simplicity and clarity and have not necessarily been drawn to scale. For example, the size dimensions and/or relative positioning of some of the elements in the figures may be exaggerated relative to other elements to help to improve understanding of various aspects of the present invention. Also, common but well-understood elements that are useful or necessary in a commercially feasible embodiment are often not depicted in order to facilitate a less obstructed view of these various aspects of the present invention. Furthermore, it will be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Wireless communication is increasingly common in mobile and vehicular applications. In addition there is a trend to reduce packages sizes, often in part to accommodate more devices or more elaborate devices in about the same amount of space or less, or to reduce the cost by reducing material usage. Moreover, there is a general drive to increase the communication system content in mobile and vehicular applications. Accordingly, since the number of wireless communication systems is generally increasing and the available package sizes or space available in the package for a given system generally decreases there is an emphasis on integration and package space use optimization while still attempting to maintain or improve performance.

Since the package is often dictated by factors other than performance, for example customer specified maximum dimensional envelope, form factor or aesthetic considerations, the antennas are often limited in size or shape by the space available inside of a package. To illustrate further, the dimensional envelope or package form factor may, for example, be defined by the customer independent of the system design and then the system designer works within the confines of the inside of that package form factor to improve or maximize the antenna performance while accommodating the other components inside of that package.

One approach to optimize the space available for wireless communication while improving antenna performance is to implement an antenna system utilizing the space typically taken up by the package itself or left over space of the dimensional envelope outside of the package, rather than just relying on an interior antenna, the interior antenna's dimensions being limited by the package's inside dimensions. This approach can also be used to minimally reengineer already designed devices for new applications by improving the wireless performance of the package and thus the entire device while leaving the design of the rest of the device, often the more complex part, unaltered or only minimally altered.

With reference to FIG. 1, in an example an antenna system 100 comprises an interior antenna 110 and a resonant structure 112 disposed on the outside of the package 124. However, in other aspects the resonant structure 112 is at least partially disposed between the outside and inside surfaces of the package 124, for example to conserve overall space, reinforce the package 124, to reduce damage or corrosion of the resonant structure 112, or to discourage counterfeiting. Furthermore, in some aspects the resonant structure 112 is at least partially contained in an interior cavity of the package 124.

With continued reference to FIG. 1, the resonant structure 112 is communicatively coupled to the interior antenna 110. Advantageously, in an aspect, the resonant structure 112 coupled to the interior antenna 110 results in a larger effective antenna, termed the antenna system 100. The larger effective antenna desirably increases the performance, for example gain and efficiency, of the device with the antenna system 100 in comparison to the performance of the device with the interior antenna 110 alone.

In an example the resonant structure 112 is inductively coupled to an interior wire loop antenna 110. A first end 118 of the wire loop antenna is communicatively coupled to at least one of a receiver, transmitter and transceiver 114. In an aspect the communicative coupling between the first end 118 and the receiver, transmitter or transceiver 114 is an electrically conductive coupling. A second end 116 of the loop antenna, different from the first end 118 of the loop antenna is electrically conductively coupled to a ground plane 120. However, in some aspects, the interior antenna 110 is a monopole antenna, a fractal antenna, or other suitable antenna coupled to a receiver, transmitter, or a transceiver 114 and suitably coupled to or uncoupled from the ground plane. Moreover, in some aspects the interior antenna 110 comprises printed circuit board trace or an antenna constructed with other suitable technology. Furthermore, in some aspects the interior antenna 110 is capacitively coupled to the resonant structure 112.

In an aspect the resonant structure 112 is communicatively coupled to the ground plane 120. In an example the communicative coupling between the resonant structure 112 and the ground plane 120 is capacitive coupling. In an example the capacitive coupled to the ground plane is via a capacitive pad 122. In some aspects the ground plane 120 is comprised in a vehicle chassis.

In an aspect the resonant structure 112 is configurable to reduce polarization mismatches between the transmitter and receiver or transceiver antennas. However, in some examples the resonant structure 112 is configured to reduce polarization mismatches between the transmitter and receiver or transceiver antennas in a fixed manner. Moreover the resonant structure 112 can be configurable or configured to reduce polarization mismatched between two or more antennas on the same device or two or more antennas of which at least one is on a different device.

In yet another aspect the resonant structure 112 is configurable to compensate for the location of the package 124 in the vehicle. However, in other examples the resonant structure 112 is configured to compensate for the location of the 124 in the vehicle in a fixed manner.

In yet another aspect the resonant structure 112 is configured to resonate at a plurality of frequencies while coupling to a single interior antenna 110. However, in other aspects the resonant structure 112 configured to resonate at a plurality of frequencies is coupled to a plurality of interior antennas 110. In one aspect, the resonant structure 112 configured to resonate at multiple frequencies and coupled to at least one interior antenna 110 is comprised in a multiple frequency antenna system 100.

Figure 2:
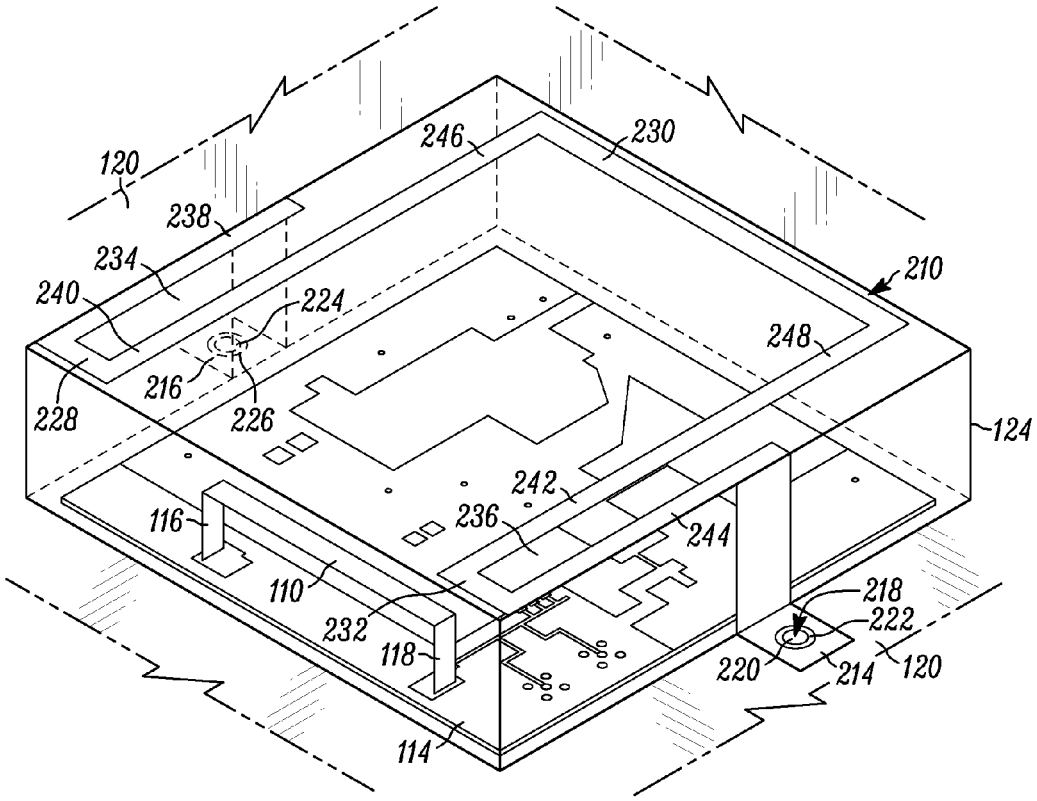

With reference to FIG. 2 and continued reference to FIG. 1, in an example the resonant structure 210, 112 is capacitively coupled to a ground plane 120, for example a vehicle chasis. The combination of the resonant structure 210 and the ground plane 120 is in turn configured to resonate at a desired frequency. The resonant structure 210 comprises an electrically conductive path having a first end 214 and a second end 216. The first end 214 of the electrically conductive path is electrically conductively coupled to the ground plane 120. The second end 216 of the electrically conductive path, different from first end of the electrically conductive path, is dielectrically insulated from the ground plane 120. However, in some aspects either the first end 214 of the electrically conductive path, the second end 216 of the electrically conductive path, or both are dielectrically insulated from the ground plane 120. In an example the resonant structure 210 is configured to accommodate at least one fastener 218 to fasten the resonant structure 210 or the package 124 to the ground plane 120. In an example the fastener 218 is electrically conductive, for example a metal bolt. However, in other aspects the fastener 218 may be any other suitable fastener, including for example a dielectrically insulating fastener. Moreover, if more than one fastener is used the fasteners may each be of the same or a different type or each made from the same or a different material, for example a conductor or a dielectric, or a combination of materials. In an example, a first fastener comprises a metal bolt 220 and a conductive washer 222 and a second fastener comprises a metal bolt 224 and a dielectric washer 226.

With further reference to FIG. 2, in an example the resonant structure 210 comprises three generally u-shaped sections electrically conductively connected in series and different from each other, the first end section 228, the middle section 230, and the second end section 232. However, in other aspects suitable shapes other than "u" may be used. The first end section 228 comprises a resonance tuning section and the second end section 232 comprises a matching tuning section, both tuning sections configured to adjust the inductance of the resonant structure 210. However, in other examples more or less than two tuning sections may be present. The tuning sections may be configured by shortening the respective gap 234 or 236 between the two substantially parallel u-sides 238 and 240 or 242 and 244 respectively, for example by electrically conductively connecting a conductor to each of the u-sides 238 and 240 or 242 and 244 to bridge a portion of the respective gap 234 or 236 between the two respective u-sides 238 and 240 or 242 and 244. Substantially parallel means at a respective angle of less than 90 degrees.

In an example, the respective u-sides 238 and 240 or 242 and 244 of each the first and second end sections 228 and 232 are separated from each other by about 3 mm, the respective gap 234 or 236 width. However, in other aspects the separation between the u-sides 238 and 240 or 242 and 244 may be suitably substantially smaller or greater than about 3 mm. In an example, the respective u-sides 246 and 248 of the middle section 230 are separated from each other by a distance substantially more than about 3 mm. However, in other aspects the separation between the u-sides 246 and 248 may be suitably insubstantially greater than about 3 mm, about 3 mm, or less than about 3 mm.

Figure 3:
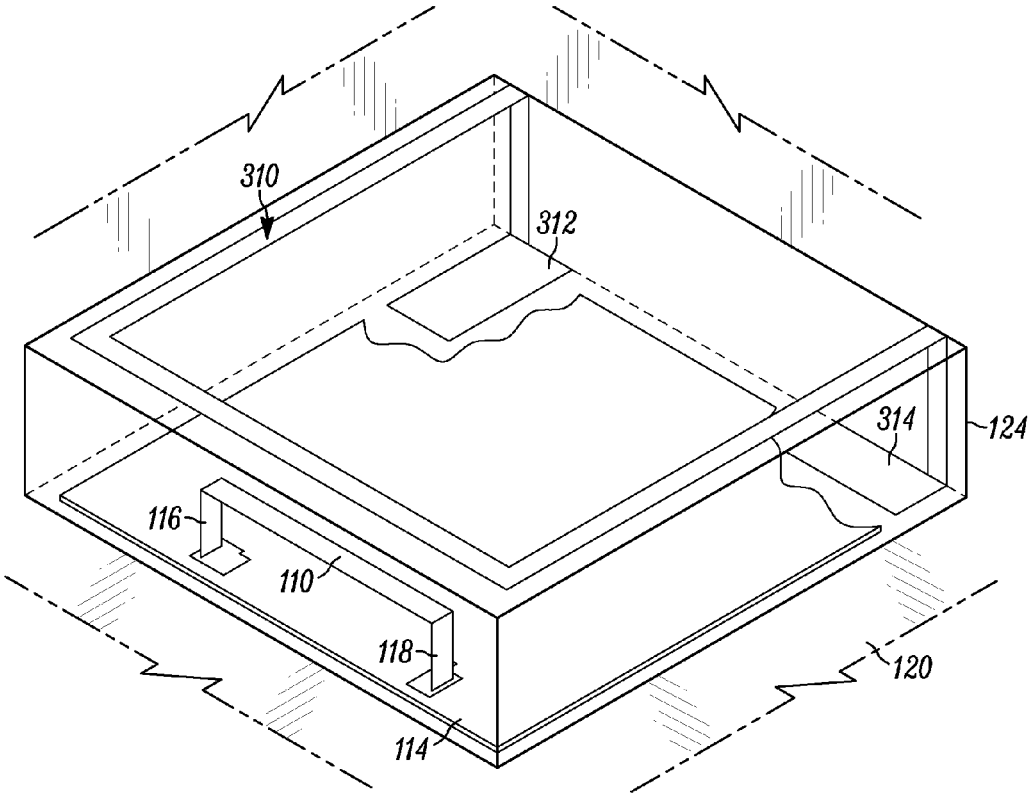

With reference to FIG. 3 and continued reference to FIG. 1, in an example the resonant structure 310 comprises a single u-shaped electrically conductive section wrapped over three sides of the package 124. However, in other aspects the electrically conductive section may be wrapped over more or less sides of the package 124, may be at least partially embedded in the walls of the package 124, or at least partially placed inside the package 124 cavity. Moreover, in some examples suitable shapes other that the u-shape may be used. In an example, the resonant structure 310 further comprises capacitive pads 312 and 314 at the ends of the u-shape, the capacitive pads 312 and 314 configured to capacitively couple with the ground plane 120. However, in some aspects the resonant structure 310 may comprise more or less than two capacitive pads. In an example, the capacitive pads 312 and 314 are configured to be substantially parallel to at least portion of the ground plane 120 when the package 124 is disposed in suitable proximity to the ground plane 120.

Figure 4:
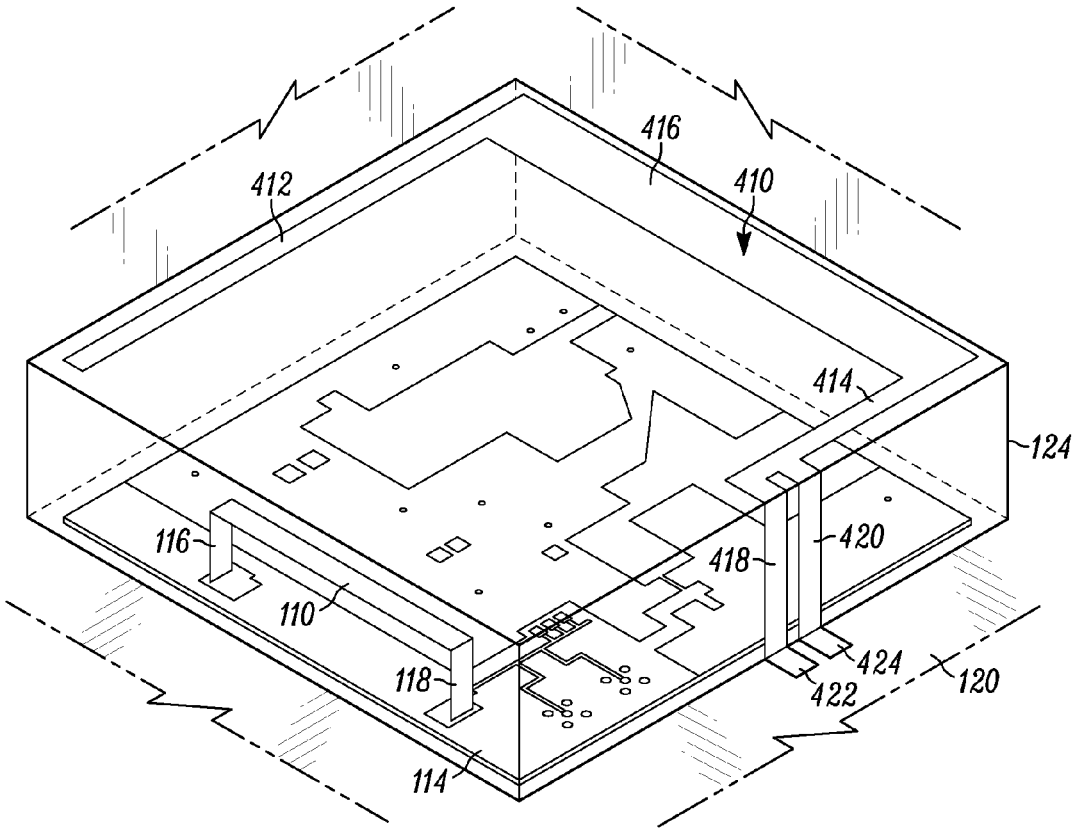

With reference to FIG. 4 and continued reference to FIG. 1, in an example the resonant structure 410 comprises a single u-shaped electrically conductive section with a first substantially parallel opposite u-side 412 being longer than a second substantially parallel opposite u-side 414. In an example the longer substantially parallel opposite u-side 412 is about twice as long as the shorter substantially parallel opposite u-side 414. However, in other aspects the relative length of the u-sides may follow any other suitable length relationship. In an example the u-bottom 416 is about twice as wide as at least one of the substantially parallel opposite u-sides 412 and 414. However, in other aspects the u-bottom 416 may be of any other suitable relative width. Moreover, in some aspects suitable shapes other that the u-shape may be used. In an example the resonant structure 410 further comprises two electrically conductive leads 418 and 420 electrically conductively connected to the shorter substantially parallel opposite u-side 414 and form capacitive pads 422 and 424.

In some examples, the resonant structure comprises metal foil about 5-8 mm wide. However, in some aspects the resonant structure may comprise metal or metallic foil, stamped metal, wire, laser etching, laser deposit, physical vapor deposit, or other suitable elements, or any suitable combination thereof and any suitable dimensions.

In an example the resonant structure is tuned to resonate at about 433 MHz. However in other examples the resonant structure is tuned to resonate at other frequencies, for example at about 300 MHz, 315 MHz, 868 MHz, 900 MHz, 1.5 GHz, 1.8 GHz, 2.4 GHz, or 5.8 GHz, or any suitable combination of the suitable frequencies.

In some examples the resonant structure is configured to act as a filter, for example, a narrowband filter, a wideband filter, or a multiband filter.

Although the above examples have been described with respect to exemplary vehicular or mobile wireless device, in an aspect, analogous suitable antenna systems may be used in any other wireless device.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention. Further, those skilled in the art will recognize that the approaches described herein may also be used to design components and devices other than vehicle and mobile wireless devices.

What is claimed is:

1. A resonant structure comprising:

an inductive section configured to inductively couple to an interior antenna, the inductive section comprising a first u-shaped end section, a u-shaped middle section, and a second u-shaped end section arranged in series in an electrically conductive path, wherein the first and the second u-shaped sections are configurable to adjust the inductance of the resonant structure, the interior antenna configured to be contained in a device package; and a capacitive section configured to capacitively couple to a ground plane so as to resonate in combination with the ground plane at a desired frequency, the ground plane being comprised in a vehicle chassis, the capacitive section further configured to be penetrated by an electrically conductive fastener, the electrically conductive fastener fastening the capacitive section to the ground plane via a dielectric penetrated by the electrically conductive fastener;

the inductive section and the capacitive section being communicatively coupled to each other.

2. The resonant structure as recited in claim 1, wherein the first u-shaped end section is electrically conductively coupled to the capacitive section and the second u-shaped section is configured to be electrically conductively coupled to the ground plane.

3. The resonant structure as recited in claim 1, wherein a first u-shaped end section and the second u-shaped end section each comprise two 5-8 mm wide conductive u-side sections separated by an about 3 mm wide dielectric gap.

4. The resonant structure as recited in claim 1, wherein the inductive section comprises a u-shaped section configured to be at least one of at least partially disposed on a surface of the device package and at least partially embedded in the device package, at least one of the ends of the u-shaped section being electrically conductively coupled to the capacitive section.

5. The resonant structure as recited in claim 4, wherein the capacitive section comprises a substantially rectangular electrically conductive pad configured to capacitively couple to the ground plane.

6. The resonant structure as recited in claim 4, wherein the u-shaped section comprises two substantially parallel opposite u-sides coupled by a u-bottom, the first u-side and the second u-side, the first u-side being substantially longer than the second u-side;

wherein the second u-side is electrically conductively connected to the capacitive section.

7. The resonant structure as recited in claim 6, wherein the first u-side is about twice as long as the second u-side.

8. The resonant structure as recited in claim 6, wherein the u-bottom is substantially wider than at least one of the u-sides.

9. The resonant structure as recited in claim 8, wherein the u-bottom is about twice the width of at least one of the u-sides.

10. A resonant antenna system, the system comprising:

an interior antenna communicatively coupled to at least one of a receiver, a transmitter, and a transceiver;

a resonant structure communicatively coupled to the interior antenna and to a ground plane, the resonant structure comprising an inductive section configured to inductively couple to the interior antenna, the inductive section comprising a first u-shaped end section, a u-shaped middle section, and a second u-shaped end section arranged in series in an electrically conductive path, wherein the first and the second u-shaped sections are configurable to adjust the inductance of the resonant structure, the resonant structure and the ground plane in combination resonating at a desired frequency, the ground plane being comprised in a vehicle chassis, the resonant structure configured to be penetrated by an electrically conductive fastener, the electrically conductive fastener fastening the resonant structure to the ground plane via a dielectric penetrated by the electrically conductive fastener.

11. The system as recited in claim 10, wherein the interior antenna is a loop antenna inductively coupled to the resonant structure and electrically conductively coupled to the ground plane.

12. The system as recited in claim 11, wherein the resonant structure is capacitively coupled to the ground plane.

13. The system as recited in claim 12, wherein the ground plane is comprised in a vehicle chassis.

14. The system as recited in claim 10, further comprising a device package defining an interior cavity;

wherein the resonant structure is at least partially contained in the interior cavity.

15. The system as recited in claim 10, wherein the resonant structure is substantially disposed on an exterior surface of the package.

16. The system as recited in claim 10, wherein the resonant structure is at least partially embedded in the device package between an exterior surface and an interior surface of the package.

17. A method of improving antenna performance, comprising the steps of:

providing an antenna, the antenna configured to be contained in a device package;

at least one of at least partially disposing a resonant structure on a device package and at least partially embedding a resonant structure on a device package, the resonant structure configured to communicatively couple to the antenna and a ground plane, the resonant structure comprising an inductive section configured to inductively couple to the interior antenna, the inductive section comprising a first u-shaped end section, a u-shaped middle section, and a second u-shaped end section arranged in series in an electrically conductive path, wherein the first and the second u-shaped sections are configurable to adjust the inductance of the resonant structure, the resonant structure and the ground plane in combination resonating at a desired frequency, the ground plane being comprised in a vehicle chassis, the resonant structure configured to be penetrated by an electrically conductive fastener, the electrically conductive fastener fastening the resonant structure to the ground plane via a dielectric penetrated by the electrically conductive fastener;

containing the antenna in the device package.

18. The method of improving antenna performance, as recited in claim 17 wherein the resonant structure is configured to inductively couple to the antenna and capacitively couple to a ground plane.

19. The method of improving antenna performance as recited in claim 17, further comprising adjusting the impedance of the resonant structure to at least one of increase resonance at a desired frequency and more closely match the impedance of the antenna.

* * * * *